US011155377B2

(12) United States Patent
Hansen et al.

(10) Patent No.: US 11,155,377 B2
(45) Date of Patent: Oct. 26, 2021

(54) CAPSULES

(71) Applicant: Intercontinental Great Brands LLC, East Hanover, NJ (US)

(72) Inventors: Nicholas Hansen, Banbury (GB); Mark Norton, Banbury (GB)

(73) Assignee: Intercontinental Great Brands LLC, East Hanover, NJ (US)

( * ) Notice: Subject to any disclaimer, the term of this patent is extended or adjusted under 35 U.S.C. 154(b) by 381 days.

(21) Appl. No.: 15/922,361

(22) Filed: Mar. 15, 2018

(65) Prior Publication Data

US 2018/0201399 A1 Jul. 19, 2018

Related U.S. Application Data

(63) Continuation of application No. 14/436,443, filed as application No. PCT/IB2013/002515 on Oct. 16, 2013, now Pat. No. 9,963,256.

(30) Foreign Application Priority Data

Oct. 19, 2012 (GB) ..... 1218848

(51) Int. Cl.
*B65B 29/02* (2006.01)
*B65B 61/20* (2006.01)
(Continued)

(52) U.S. Cl.
CPC ..... *B65B 29/02* (2013.01); *B65B 29/022* (2017.08); *B65B 47/04* (2013.01); *B65B 61/20* (2013.01);
(Continued)

(58) Field of Classification Search
CPC ... B65D 85/8043; B65B 29/022; B65B 29/02; B65B 47/04; B65B 61/20
See application file for complete search history.

(56) References Cited

U.S. PATENT DOCUMENTS 3,628,301 A * 12/1971 Vermeulen ..... B29C 65/18 53/412
4,092,817 A * 6/1978 Rist, III ..... B65B 7/164 53/298

(Continued)

FOREIGN PATENT DOCUMENTS

BE 1019661 9/2012
CA 2565390 11/2005

(Continued)

OTHER PUBLICATIONS

Intellectural Property Office Combined Search and Examination Report, dated Feb. 20, 2013 for Application No. GB1218848.8 (5 pgs.).

(Continued)

*Primary Examiner* — Andrew M Tecco
(74) *Attorney, Agent, or Firm* — Fitch, Even, Tabin & Flannery LLP

(57) ABSTRACT

The present invention provides a method of assembling a filter element (8) with a cup-shaped capsule body (2) using a combined weld-head (70) and former (80), comprising the steps of positioning the filter element (8) at or near a mouth of the cup-shaped capsule body (2), moving the combined weld-head (70) and former (80) so as to contact and drive the filter element (8) into the cup-shaped capsule body (2), wherein, the filter element (8) is deformed by a sprung-loaded former (80) of the combined weld-head (70) and former (80) to form a cup-shaped filter element (56), and using a weld-head (70) of the combined weld-head (70) and former (80) to bond the cup-shaped filter element (56) to the cup-shaped capsule body (2). The present invention further provides a method of making a beverage capsule and a beverage capsule produced using this method.

23 Claims, 5 Drawing Sheets

(51) Int. Cl.
*B65D 85/804* (2006.01)
*B65B 47/04* (2006.01)

(52) U.S. Cl.
CPC ..... *B65D 85/8043* (2013.01); *Y10T 156/1033* (2015.01)

(56) References Cited

U.S. PATENT DOCUMENTS 4,625,498 A * 12/1986 Parsons ..... B65B 7/164 156/261
4,736,568 A * 4/1988 Shaw ..... B29C 65/18 53/297
5,331,793 A * 7/1994 Pophal ..... A47J 31/08 493/154
5,371,996 A * 12/1994 Ueda ..... B65B 7/164 53/298
5,840,189 A 11/1998 Sylvan
5,941,055 A * 8/1999 Coates ..... B65B 61/20 425/112
6,440,256 B1 * 8/2002 Gordon ..... A47J 31/08 156/293
8,276,639 B2 * 10/2012 Binacchi ..... B65B 61/065 156/566
2005/0051478 A1 * 3/2005 Karanikos ..... B65D 85/8043 210/469
2005/0217213 A1 * 10/2005 Lozinski ..... A47J 31/44 53/453
2009/0211713 A1 * 8/2009 Binacchi ..... B65B 61/065 156/423
2012/0015080 A1 1/2012 Roulin
2013/0277887 A1 10/2013 Howarth

FOREIGN PATENT DOCUMENTS

| | | |
|---|---|---|
| CN | 1355759 | 6/2002 |
| CN | 1849249 | 10/2006 |
| CN | 102365214 | 2/2012 |
| CN | 103298599 | 9/2013 |
| EP | 2093148 | 8/2009 |
| WO | 0068113 | 11/2000 |

OTHER PUBLICATIONS

Intellectural Property Office Response made to Report, dated Dec. 18, 2013 for Application No. GB1218848.8 (1 pg.).
International Search Report and Written Opinion of the International Searching Authority, dated Mar. 19, 2014 for International Application No. PCT/IB2013/002515 (14 pgs.).
Notification of the First Office Action, dated Oct. 23, 2015 for Chinese Application No. 201380053242.0 with English translation (15 Pgs.).
Response to Combined Search and Examination Report, dated Jun. 14, 2013 for Application No. GB1218848.8 (5 pgs.).
The Second Office Action for Chinese Patent Application No. 201380053242.0, with English tanslation (13 pgs.).
Examination Report, dated Dec. 29, 2020 for corresponding Indian Patent Application No. 201948036342 (7 pgs.).

* cited by examiner

CAPSULES

CROSS-REFERENCE TO RELATED APPLICATIONS

This application is a continuation of U.S. patent application Ser. No. 14/436,443, filed Apr. 16, 2015, which is a U.S. national phase application of International Application No. PCT/IB2013/002515, filed Oct. 16, 2013, which claims the benefit of Great Britian Application No. 1218848.8, filed Oct. 19, 2012, which are all hereby incorporated herein by reference in their entireties.

FIELD

The present application relates to improvements in or relating to capsules. In particular, it relates to a weld-head and former for use in the assembly of capsules, such as beverage capsules. The application also relates to methods of assembly utilising said weld-head and former and uses of capsules produced by said methods.

BACKGROUND

Capsules for containing beverage ingredients are well known. One type of known capsule is described in U.S. Pat. No. 5,840,189 and comprises a cup-shaped capsule body having a base, a truncated conical side wall and an open mouth. The open upper mouth is hermetically sealed by a lid. The cup-shaped capsule body and lid define a capsule volume in which is located a filter element and a portion of beverage ingredients. In use, the lid and base are both pierced to allow for the injection of hot water into the capsule volume, and the delivery of an extracted beverage out of the capsule volume. The filter element serves to allow the extracted beverage to pass there through while retaining the solid residue of the beverage ingredients. In U.S. Pat. No. 5,840,189 the filter element is permanently joined to an interior surface of the conical side wall at a location adjacent to the open mouth.

U.S. Pat. No. 6,440,256 describes a method of forming and inserting a filter element into a cup-shaped capsule body of the type described in U.S. Pat. No. 5,840,189. In particular, the method first requires the folding and sealing of a filter material to form a filter element. The filter element is then transferred to the location of a cup-shaped capsule body by a first mandrel. A probe is then lowered relative to the first mandrel to strip the filter element off the first mandrel with a heated tip of the probe being used to tack weld a bottom of the filter element to the base of the cups shaped capsule body. Next, the probe is withdrawn and a shaping mandrel is inserted to radially expand the filter element against the interior side wall of the cup-shaped capsule body. The shaping mandrel is then withdrawn and a welding mandrel is inserted to effect a peripheral weld between the filter element and the side wall.

This prior art method involves a number of individual stages and require three separate mandrels. It is also unsuitable for assembling a filter element in a capsule where the filter element does not extend to the base of the cup-shaped capsule body.

SUMMARY OF THE DISCLOSURE

According to the present disclosure there is provided a method of assembling a filter element with a cup-shaped capsule body using a combined weld-head and former, comprising the steps of:

a) positioning the filter element at or near a mouth of the cup-shaped capsule body;

b) moving the combined weld-head and former so as to contact and drive the filter element into the cup-shaped capsule body;

c) wherein, during step b), the filter element is deformed by a sprung-loaded former of the combined weld-head and former to form a cup-shaped filter element; and d) using a weld-head of the combined weld-head and former to bond the cup-shaped filter element to the cup-shaped capsule body.

Advantageously, the combined weld-head and former achieves, in a single operation, the multiple functions of inserting the filter element into the cup-shaped capsule body, shaping the filter element into a cup-shaped filter element, and the bonding together of the cup-shaped filter element and the cup-shaped capsule body. This allows for a less complicated and quicker assembly procedure. The method is also suitable for assembling a filter element in a capsule where the filter element does not extend to a base of the cup-shaped capsule body.

A magnitude of a peak force applied to the filter element by the sprung-loaded former may be limited by allowing the sprung-loaded former to move relative to the weld-head against a spring bias.

Typically, the filter material is made from a material having a relatively low tear strength. The present applicant has found that using a solid, non-compliant former to drive the filter element into the cup-shaped capsule body can lead to tearing of the filter element if too high a load is applied to the filter element by the former. By use of the sprung-loaded former of the present disclosure the likelihood of tearing of the filter element is lessened or avoided since the peak force applied by the former to the filter element may be moderated by the compliance of the former.

Consequently, the magnitude of the peak force applied to the filter element is preferably less than the force required to tear the cup-shaped filter element. For example, the magnitude of the peak force applied to the filter element may be less than 45N, preferably less than 40N, more preferably less than 30N.

At the end of step b), a portion of the cup-shaped filter element may be held in contact with the cup-shaped capsule body by the weld-head. Advantageously, this allows bonding of the cup-shaped filter element and the cup-shaped capsule body to take place immediately after the filter element has been deformed into the cup-shaped filter element. In other words, a single stroke of the combined weld-head and former not only inserts and deforms the filter element into the required shape but also readies the cup-shaped filter element for a bonding step. This avoids the need for a plurality of reciprocal machine movements to insert, deform and bond the filter element, which thus results in a faster assembly process.

The cup-shaped filter element may be bonded to the cup-shaped capsule body such that the cup-shaped filter element is suspended within the cup-shaped capsule body, with a base of the cup-shaped filter element being out of contact with a base of the cup-shaped capsule body.

During step d), a portion of the cup-shaped filter element may be bonded to the cup-shaped capsule body by using a heated portion of the weld-head. The weld-head may be heated by a resistive heater coil or resistive band. The heated portion may comprise a heated ceramic component.

During step d), at least a portion of the cup-shaped capsule body may be softened by the heated portion of the weld-head, thereby allowing the weld-head to move further into the cup-shaped capsule body.

The heat applied to the cup-shaped capsule body may result in softening of the material of the cup-shaped capsule body and/or may result in localised thinning of a side wall of the cup-shaped capsule body. In either case this may allow the weld-head to move further into the cup shaped capsule body since the reaction force applied to the weld-head by the cup-shaped capsule body may be reduced by the material softening.

During said further movement of the weld-head into the cup-shaped capsule body, further movement of the sprung-loaded former into the cup-shaped capsule body may be limited or avoided by allowing the sprung-loaded former to move relative to the weld-head against a spring bias.

Advantageously, even where the weld-head does move further into the cup-shaped capsule body, movement of the former further into the cup-shaped capsule body is either limited or avoided due to the former being sprung-loaded. In other words, the additional displacement of the weld-head is partially or wholly accommodated by compression of the spring bias existing between the weld-head and the former. This significantly lessens or eliminates any additional loading being applied to the cup-shaped filter element during the bonding step.

The sprung-loaded former may be slidably coupled to the weld-head, with a compression spring extending between the sprung-loaded former and the weld-head. As an alternative to a compression spring, the former may be sprung-loaded by, for example, use of an elastomeric spring, a gas spring, a gas strut, or another arrangement providing compliance between the weld-head and the former or compliance within the former itself. The element providing compliance may be a separate element or may form an integral part of either the weld-head or former. The material and/or the shape of the former may produce the compliance.

The method may further comprise the step of:

e) withdrawing the combined weld-head and former from the cup-shaped capsule body.

During step e) the sprung-loaded former may flex to aid decoupling of the sprung-loaded former from the cup-shaped filter element.

The former may be formed from a rigid material. In some aspects using a flexible former may reduce the risk that the cup-shaped filter element will be torn on withdrawal of the combined weld-head and former. A part or a whole of the former may therefore be formed from a flexible material. Alternatively, the former may comprise a geometric shape providing an inherent flexibility.

The present disclosure also provides a method of making a beverage capsule, comprising the steps of:

i) filling a portion of one or more beverage ingredients into a cup-shaped capsule body having a filter element bonded thereto by the method described above; and ii) closing and sealing the cup-shaped capsule body using a lid.

The present disclosure also provides a beverage capsule produced using the method described above.

The one or more beverage ingredients may be an extractable/infusible ingredient such as roasted ground coffee or leaf tea. The beverage ingredients may be a mixture of extractable/infusible ingredients and water-soluble ingredients. The water-soluble ingredient may be, for example, an instant spray-dried or freeze-dried coffee, a chocolate powder, a milk powder or a creamer powder. Milk powders may include dried skimmed milk, part-skimmed milk, and whole milk, dried milk protein concentrates, isolates, and fractions, or any combination thereof. Creamer powders may be manufactured from dairy and/or non-dairy food ingredients and typically contain emulsified fat, stabilized by protein or modified starch, dispersed in a carrier that facilitates drying, especially spray drying. The powdered ingredient may be agglomerated.

The present disclosure also provides a combined weld-head and former for use in assembling a beverage capsule, comprising a weld-head and a former, wherein the former is sprung-loaded.

The sprung-loaded former may be slidably coupled to the weld-head, with a spring extending between the sprung-loaded former and the weld-head.

As noted above, the spring may be a compression spring, an elastomeric spring, a gas spring, a gas strut or another arrangement providing compliance between the weld-head and the former. The element providing compliance may be a separate element or may form an integral part of either the weld-head or former.

The sprung-loaded former may comprise a forming body. At least a portion of the forming body may be flexible.

The present disclosure also provide for use of a combined weld-head and former as described above to assemble a filter element with a cup-shaped capsule body.

The cup-shaped capsule body may be formed from a polymeric material. For example, it may be formed from polypropylene, polyester, polystyrene, nylon, polyurethane, acetal, acetal grade polyoxylene methylene copolymer (e.g. Centrodal C), or other engineering plastics.

The cup-shaped capsule body may comprise a laminated material. For example, the cup-shaped capsule body may comprise a laminate of polystyrene and polyethylene. In another example, the cup-shaped body may be formed from a laminate having layers of polystyrene, ethylene vinyl alcohol (EVOH) and polyethylene.

The cup-shaped capsule body may comprise a barrier layer. The barrier layer may form one layer of a laminate structure of the cup-shaped capsule body. The barrier layer may be substantially impermeable to oxygen/air and/or moisture. Preferably the barrier layer acts to preserve the contents of the capsule from potential degradation due to exposure to oxygen/air and/or moisture. An example of a suitable barrier layer is EVOH.

Suitable materials for the filter element include heat-sealable woven and non-woven materials, paper, and cellulose as well as plastics such as polypropylene and polyethylene. The paper or cellulose material may contain fibres of another material, for example, polypropylene or polyethylene.

The sprung-loaded former may be made in whole or in part from a material which is heat resistant. The sprung-loaded former may be formed from a rigid material such as aluminium, mild steel, copper, brass or stainless steel. It may also be made from a non-metallic material such as a ceramic or a polymer. The polymer may comprise synthetic resin bonded fabric, for example, a phenol formaldehyde resin including additional woven cotton or linen fabrics. One example of such is Tufnol® available from Tufnol Composites Ltd., of Birmingham, UK. The sprung-loaded former may be made in whole or in part from a material which is flexible. One example is silicone.

DESCRIPTION OF THE DRAWINGS

Aspects of the present disclosure will now be described, by way of example only, with reference to the accompanying drawings, in which.

DETAILED DESCRIPTION

Figure 4:
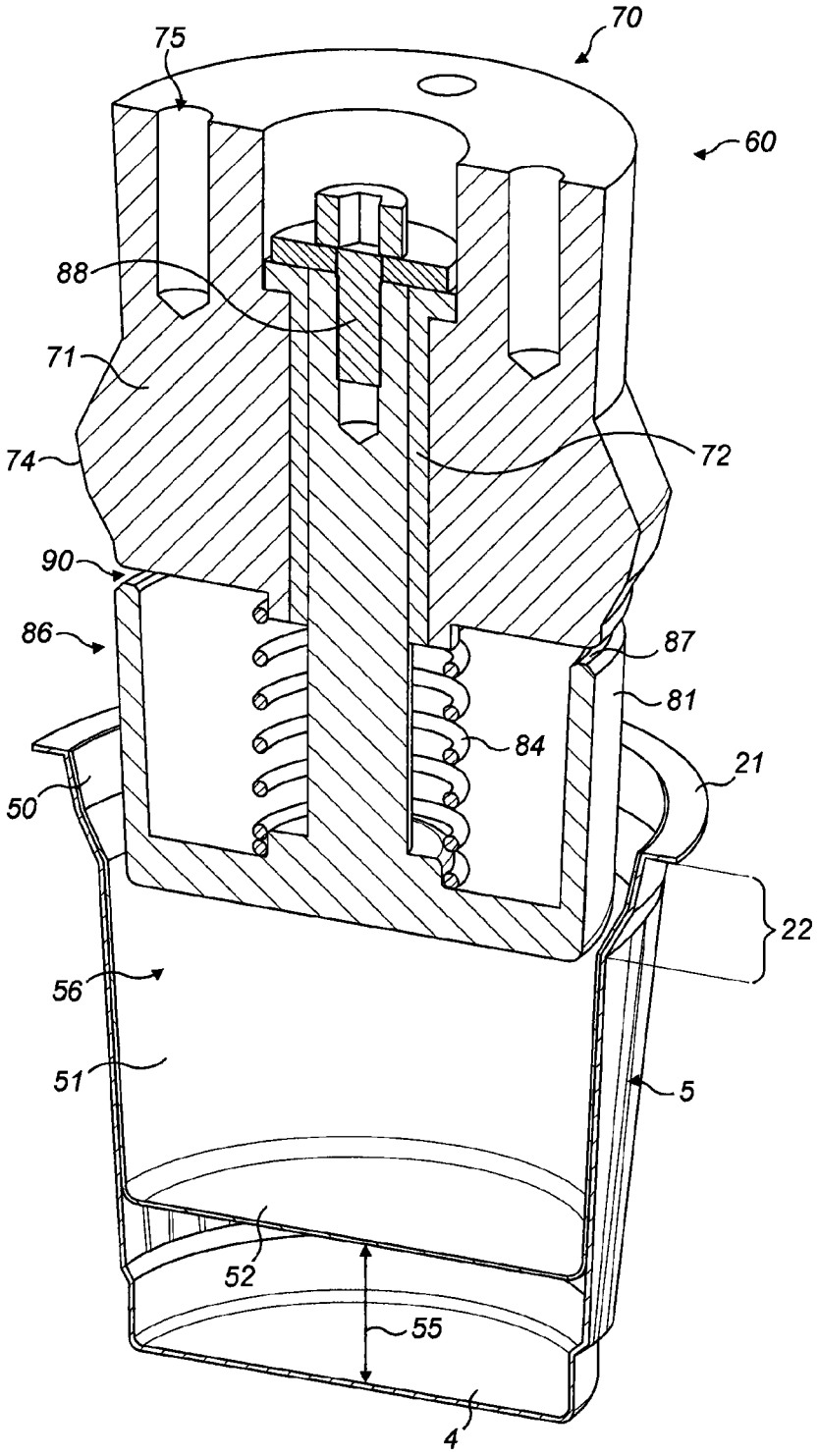
FIG. 4 is a cross-sectional representation of the combined weld-head and former being withdrawn from the cupshaped capsule body.
Figure 5:
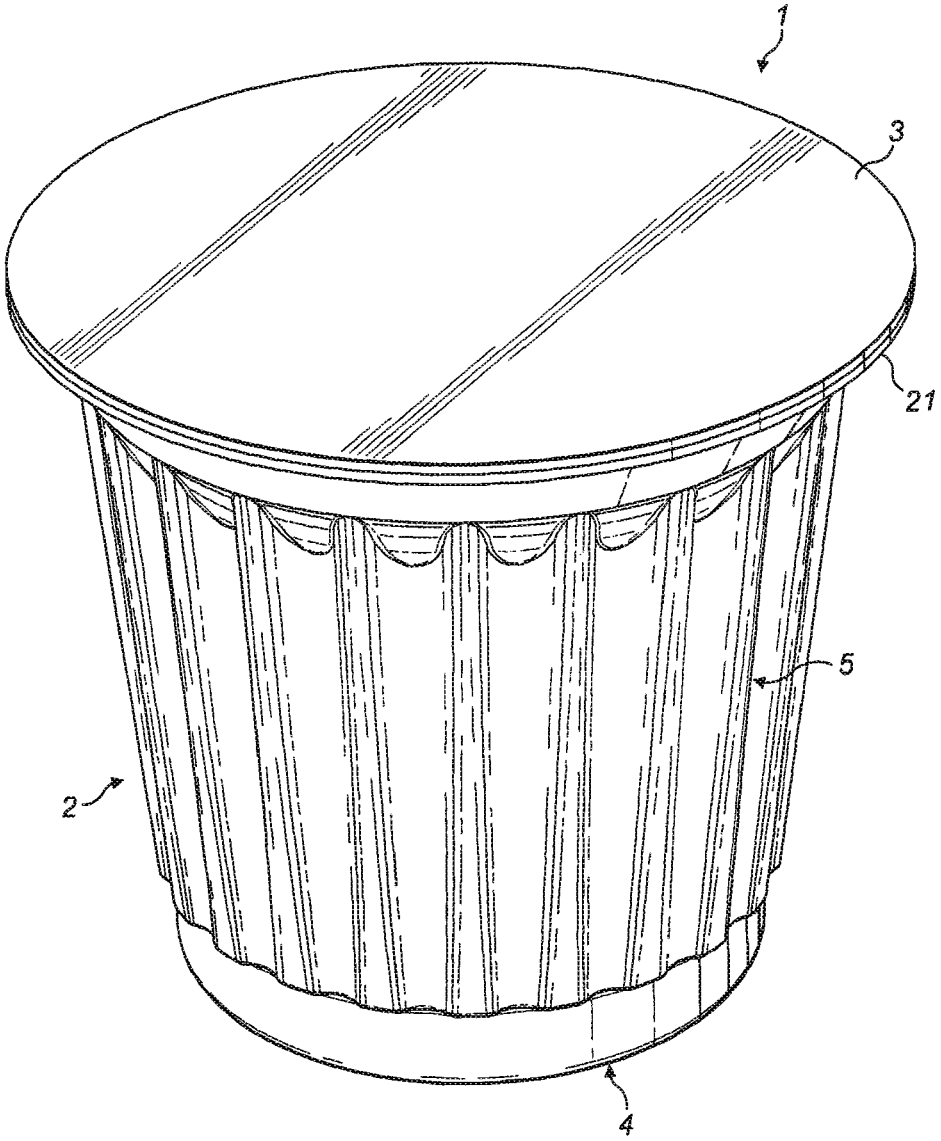
FIG. 5 is a perspective representation of a capsule formed using the cup-shaped capsule body of FIG. 4.

A capsule 1, which may be, for example, a beverage capsule containing a portion of one or more beverage ingredients, is shown in FIG. 5. The capsule 1 comprises a cup-shaped capsule body 2 having a base 4 of a circular shape and an upwardly extending side wall 5. An open upper end of the cup-shaped capsule body 2 is closed and sealed by a lid 3. The capsule 1 contains a cup-shaped filter element 56 (shown in FIG. 4) which serves to allow a liquid to pass there through while retaining a solid residue. The lid 3 provides an upper piercing surface of the capsule 1. The base 4 provides a lower piercing surface of the capsule 1.

The cup-shaped. capsule body 2 may be formed from a laminate having layers of polystyrene, ethylene vinyl alcohol (EVOH) and polyethylene.

The lid 3 may be formed from polyethylene, polypropylene, polyesters including polyethylene terephthalate, polyvinyl chloride, polyvinylidene chloride, polyamides including nylon, polyurethane, paper, viscose and/or a metal foil. The lid may comprise a laminate, be metallised or formed of copolymers. In one example, the lid comprises a polyethylene-aluminium laminate.

Figure 1:
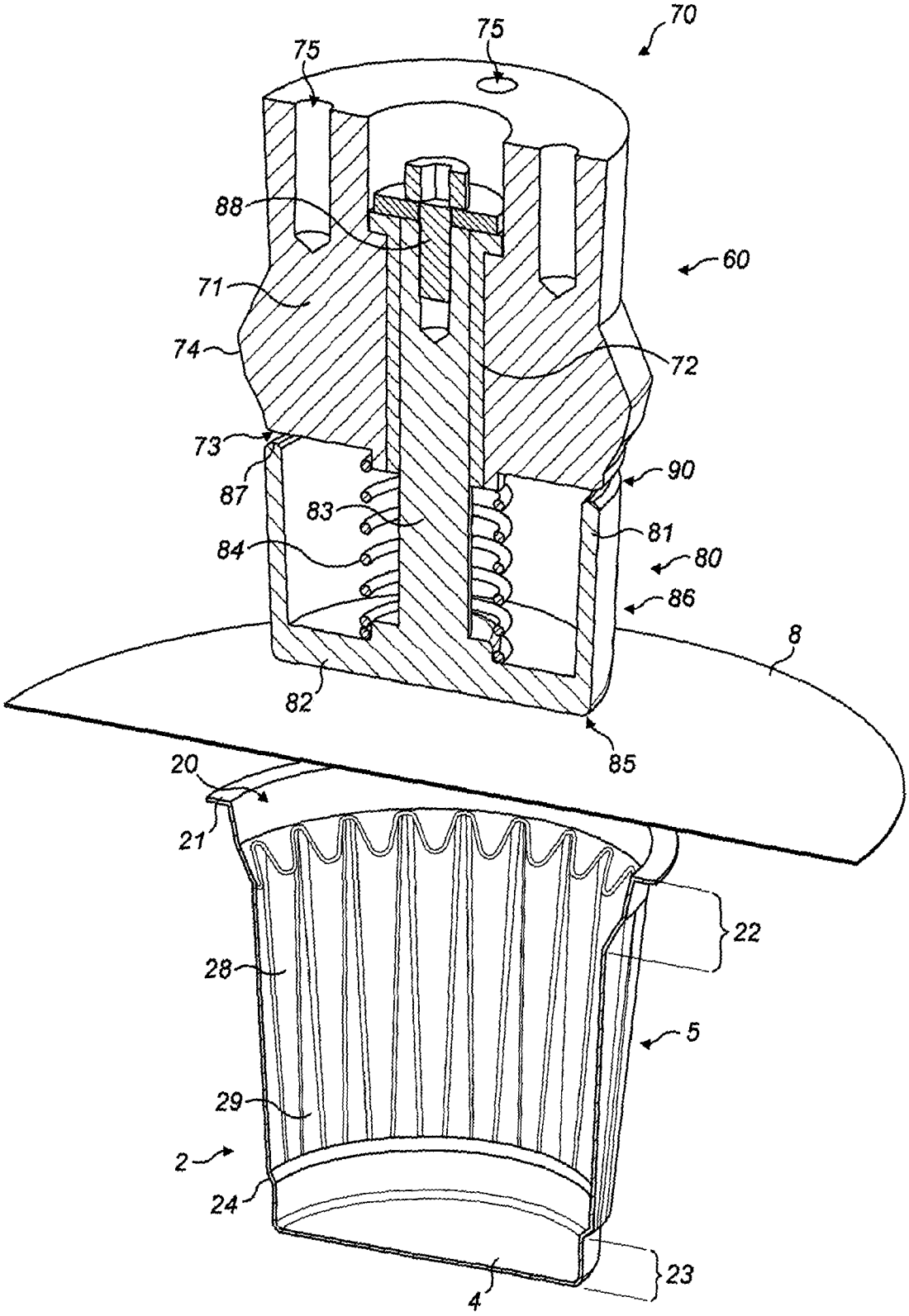
FIG. 1 is a cross-sectional representation of a combined weld-head and former, a cup-shaped capsule body and a filter element before assembly.

FIG. 1 shows the cup-shaped capsule body 2 and a filter element 8 from which the cup-shaped filter element 56 will be formed. The filter element 8 comprises a flexible, die-cut circular piece of suitable heat-sealable filter material.

FIG. 1 also shows a combined weld-head and former 60 that is used to assemble the filter element 8 with the cupshaped capsule body 2.

As shown in FIG. 1, the side wall 5 of the cup-shaped capsule body is provided on its inner face with a plurality of flutes 28 that project radially inwards so as to define channels 29 interposed between the flutes 28 which run down a substantial length of the side wall 5 from the open upper end 20 towards the base 4. The side wall 5 is generally frusto-conical in shape with a diameter at the open upper end 20 being larger than a diameter at the side wall 5 adjacent to the base 4. An upper region of the side wall 5 adjacent to the upper rim 21 has an inwardly tapering section 22 extending downwardly from the upper rim 21. In addition, the side wall 5 in the region of the base 4 is provided with an outwardly tapering section 23. An upper end of the outwardly tapering section 23 connects to the remainder of the side wall 5 at an out-turned shoulder 24.

The combined weld-head and former 60 comprises a weldhead 70 and a sprung-loaded former 80.

The weld-head 70 comprises a generally solid body 71 having a bore 72 running there through. The bore 72 is located at a centre of the solid body 71 and orientated along a longitudinal axis of the weld-head 70. An upper end of the solid body 71 is provided with a plurality of threaded bores 75 to allow the weld-head 70 to be coupled to a mechanism (not shown) that controls movement and heating of the weld-head 70. A lower end face 73 of the weld-head 70 is perpendicular to the longitudinal axis. A welding zone 74 towards a lower end of the solid body 71 is shaped to conform with the cup-shaped capsule body 2. In the illustrated example the welding zone 74 comprises two tapered surfaces that conform in shape to inwardly tapering section 22 of the cup-shaped capsule body 2. The weld-head may be formed from a suitable material able to transmit heat energy via the welding zone 74. Examples include mild steel, aluminium, copper and brass.

The sprung-loaded former 80 comprises a forming body 86, a coupling leg 83 and a spring 84. The forming body 86 comprises a base 82 of a circular shape and a side wall 81 which extends upwardly from the base 82 and terminates in a circular rim 87. The side wall 81 has a frusto-conical shape, the inclination of which generally conforms to the inclination of the side wall 5 of the cup-shaped capsule body 2. An outer corner 85 at the junction between the side wall 81 and the base 82 is radiused to prevent any sharp edges which might tear the filter element 8. The coupling leg 83 extends upwardly from the base 82 within the side wall 81. The coupling leg 83 is cylindrical and located at a centre of the forming body 86 and is shaped and sized to be received as a sliding fit within the bore 72 of the weld-head 70. The forming body 86 is made of a rigid material, such as aluminium or copper. Alternatively, a material with a degree of flexibility, such as a silicone rubber, could be utilised.

The spring 84 is located about the coupling leg 83 and extends from an inner face of the base 82 to the lower end face 73 of the weld-head 70. The spring is a helical compression spring.

The coupling leg 83 is retained within the bore 72 by means of a threaded bolt, bore and washer arrangement 88 at an upper end of the coupling leg 83.

As assembled and viewed in the orientation shown in FIG. 1, the sprung-loaded former 80 at rest is biased downwards away from the weld-head 70 by the spring 84 such that a gap 90 exists between the circular rim 87 of the side wall of the forming body 86 and the lower end face 73 of the weld-head 70.

Figure 2:
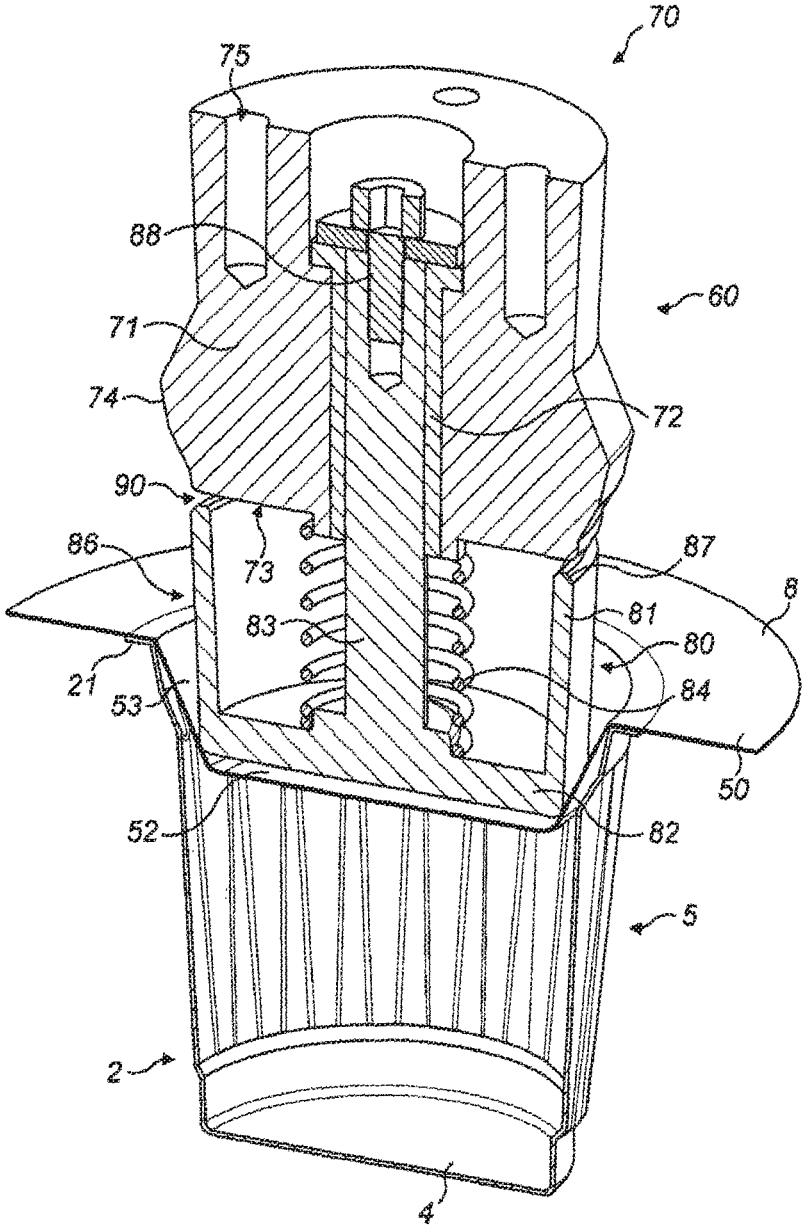
FIG. 2 is a cross-sectional representation of the filter element being inserted into the cup-shaped capsule body by the combined. weld-head and former.
Figure 3:
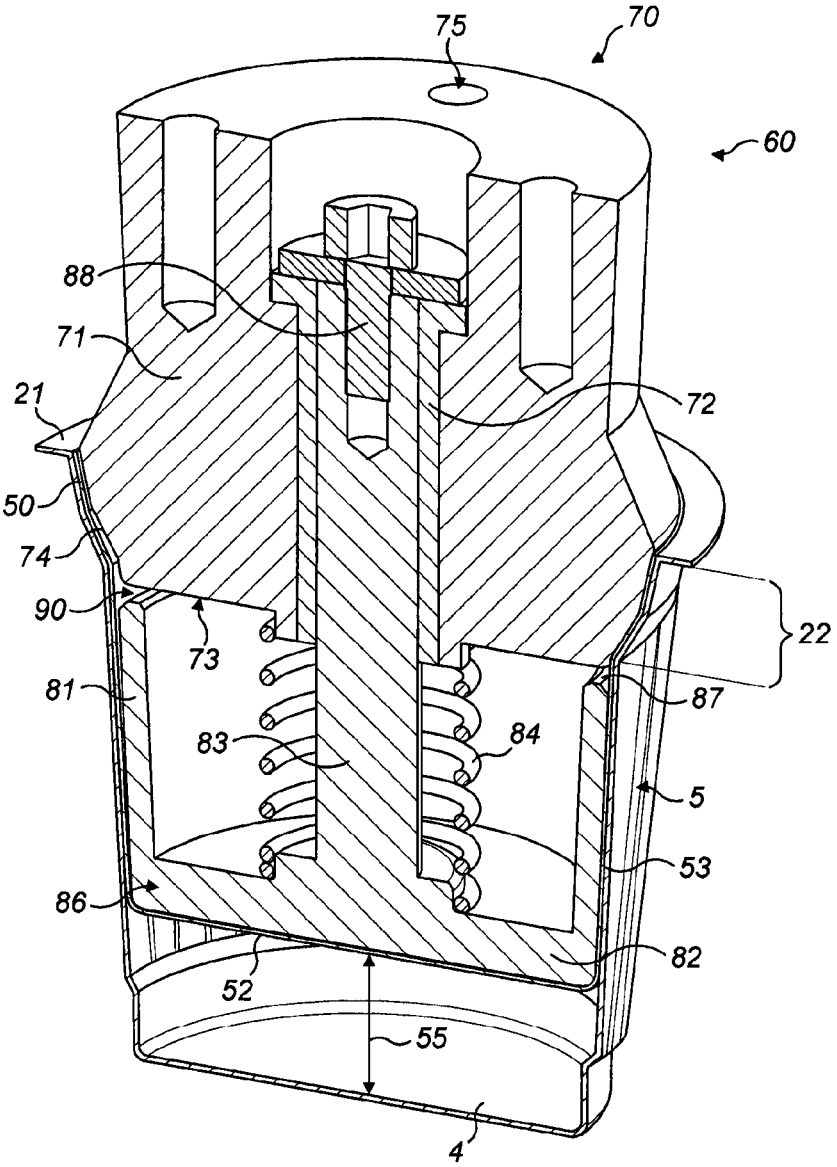
FIG. 3 is a cross-sectional representation of the filter element inserted into the cup-shaped capsule body and ready for bonding.

The steps in assembling the filter element 8 with the cup-shaped capsule body 2 are shown in FIGS. 2 to 4.

In a first step shown in FIG. 2, the cup-shaped capsule body 2 is supported in a suitable holder (not shown) and the combined weld-head and former 60 is moved downwards by mechanical means such that the filter element 8 is driven down into the open upper end 20 of the cup-shaped capsule body 2 by the sprung-loaded formed 80. This movement causes the previously flat filter element 8 to begin to be deformed into the cup-shaped filter element 56. A central portion of the filter element 8 contacted by the base 82 of the forming body 86 will become a base 52 of the cup-shaped filter element 56. An intermediate zone 53 of the filter element 8 will form a portion of a side wall 51 of the cup-shaped filter element 56. A peripheral zone 50 of the filter element 8 will form a bonded zone of the side wall 51 of the cup-shaped filter element 56. During this first stage the resistance to movement of the filter element 8 is low and consequently the sprung-loaded former 80 moves in unison with the weld-head 70 and the size of the gap 90 remains substantially unchanged.

Insertion of the combined weld-head and former 60 continues until the point is reached, shown in FIG. 3, where the filter element 8 has been fully inserted and the weld-head 70 has been brought into contact with the peripheral zone 50 of the filter element 8. At this point the filter element 8 has been fully deformed into the cup-shaped filter element 56. Also, the welding zone 74 of the weld-head 70 acts to firmly hold the peripheral zone 50 of the filter element 8 against the inwardly tapering section 22 of the cup-shaped capsule body 2. As can be seen from FIG. 3, the base 52 of the cup-shaped filter element 56 is held free of the base 4 of the cup-shaped capsule 2 by a distance 55. Up to this point the resistance to movement of the filter element 8 remains low and consequently the sprung-loaded former 80 moves in unison with the weld-head 70 and the size of the gap 90 remains substantially unchanged.

Bonding of the cup-shaped filter element 56 to the cup-shaped capsule body 2 now takes place due to heat energy from the welding zone 74 causing localised fusing of the material of the filter element 8 and the cup-shaped capsule body 2. The heating of the material of the cup-shaped capsule body 2 has been found to have a tendency to soften and/or thin the cup-shaped capsule body 2. This allows the weld-head 70 to move downwards, further into the cup-shaped capsule body 2. This further inward movement of the weld-head 70 would have a tendency, if the forming body 86 were not sprung-loaded, to impart an increased force to the cup-shaped filter element 56 (which is now not free to move relative to the cup-shaped capsule body 2). However, the sprung-loaded form of the former 80 means that the further inward movement of the weld-head 70 is accommodated by compliance of the combined weld-head and former 60—specifically it is accommodated by compression of the spring 84 so as to move the forming body 86 relative to the weld-head so as to reduce the size of the gap 90.

The final stage, shown in FIG. 4, is to withdraw the combined weld-head and former 60. At this stage, withdrawal of the forming body 86 from the cup-shaped filter element 56 may be aided, the case where the forming body 86 is formed from a flexible material, by flexing of the forming body 86 which reduces the chances of tearing of the cup-shaped filter element 56.

The assembly of the cup-shaped filter element 56 and the cup-shaped capsule body 2 may then undergo further process steps in order to fill the capsule with a portion of one or more beverage ingredients and to apply the lid 3.

As part of the assembly method described above, the spring rate of the sprung-loaded former 80 should be chosen as required depending on the particular geometry of the cup-shaped capsule body 2 and the material of the filter element 8 to ensure that the peak load imparted to the filter element a/cup-shaped filter element 56 does not exceed its tearing strength. The spring rate of the sprung-loaded former 80 depends not only on the spring rate of the spring 84 itself but also the effects of friction between the components of the former 80. In one experiment, a circular piece of filter material comprising woven paper and polyethylene of diameter 0.97 mm and thickness 0.1 mm, was bonded according to the method described above in a cup-shaped capsule body 2 having an inner face formed from polyethylene and an internal diameter at the open upper mouth 20 of 45 mm. The depth of the cup-shaped filter element 56 so formed was 33 mm. For this example a spring rate of from 2.0 to 4.0 N/mm, preferably 3.0 N/mm for the sprung-loaded former 80 was found to be beneficial. This was achieved with use of a helical compression spring having a spring rate of from 1.0 to 3.0 N/mm, preferably 2.0 N/mm.

EXAMPLES

Tests were conducted to ascertain the tearing strength of a typical filter element. The results are shown in Table 1 below. The filter element comprised a circular piece of filter material comprising woven paper and polyethylene of diameter 97 mm and thickness 0.1 mm. A forming body 86 was driven at a fixed rate of 100 mm/minute until tearing of the filter element occurred.

TABLE 1

| Test | Peak force at point of tearing (N) |
|---|---|
| Run 1 | 51.18 |
| Run 2 | 49.72 |
| Run 3 | 58.67 |
| Run 4 | 58.46 |
| Run 5 | 62.59 |
| Run 6 | 53.05 |
| Run 7 | 53.83 |
| Run 8 | 48.05 |

From this, it can be seen that, for this example, limiting the peak force applied to the filter element 8/cup-shaped filter element 56 to under 48N is preferred to reduce or eliminate the chances of tearing.

Comparative tests were then undertaken to compare the peak force applied to the filter element 8/cup-shaped filter element 56 using the method of the present disclosure (making use of a sprung-loaded former 80) compared to an assembly method using a weld-head and former that consists of a solid bung former that is not sprung-loaded relative to the weld-head. As above, the filter material comprised woven paper and polyethylene of diameter 97 mm and thickness 0.1 mm. The capsule body 2 comprised an inner face formed from polyethylene and an internal diameter at the open upper mouth 20 of 45 mm. The depth of the cup-shaped filter element 56 formed was 33 mm. For the combined weld-head and former 60, a spring rate of 3.0 N/mm for the sprung-loaded former 80 was chosen by use of a compression spring having a spring rate of 2.0 N/mm. The results are shown in Table 2 below.

TABLE 2

| Test | Peak force applied (N) | Observations |
|---|---|---|
| Solid bung former Run 1 | 50.30 | Tearing observed |
| Solid bung former Run 2 | 54.83 | No tearing |
| Solid bung former Run 3 | 52.58 | Tearing observed |
| Sprung-loaded former Run 1 | 25.22 | No tearing |
| Sprung-loaded former Run 2 | 27.62 | No tearing |
| Sprung-loaded former Run 3 | 25.37 | No tearing |
| Sprung-loaded former Run 4 | 27.00 | No tearing |
| Sprung-loaded former Run 5 | 26.93 | No tearing |

Use of the sprung-loaded formed resulted in a significantly reducing peak load being applied to the filter element a/cup-shaped filter element 56 and in every case prevented tearing of the material.

In the above aspect, the forming body 86 comprises an intergral, cup-shaped, thin-walled structure. However, other forms of forming member may be used as part of the sprung-loaded former 80. For example, the forming body 86 may be formed from a plurality of separate parts. The forming body 86 may comprise a base 82 but no side wall.

The invention claimed is:

1. A method of assembling a filter element with a cup-shaped capsule body using a combined weld-head and former, comprising the steps of:

a) positioning the filter element at or near a mouth of the cup-shaped capsule body;

b) moving the combined weld-head and former so as to contact and drive the filter element into the cup-shaped capsule body;

c) wherein, during step b), the filter element is deformed by a spring-loaded former of the combined weld-head and former to form a cup-shaped filter element; and d) using a weld-head of the combined weld-head and former to bond the cup-shaped filter element to the cup-shaped capsule body;

wherein the spring-loaded former can move toward the weld-head against a spring bias; and wherein a distance between the weld-head and a bottom of the spring-loaded former can vary during step d) by allowing the spring-loaded former to move toward the weld-head against the spring bias to limit movement of the former into the cup-shaped capsule body;

wherein the spring-loaded former comprises a cup-shaped forming body, wherein a cup-shaped portion of the forming body is wholly formed from a flexible material, and wherein the forming body comprises a base and an upwardly extending side wall.

2. A method as claimed in claim 1, wherein a magnitude of a peak force applied to the filter element by the spring-loaded former is limited by allowing the spring-loaded former to move relative to the weld-head against a spring bias.

3. A method as claimed in claim 2, wherein the magnitude of the peak force applied to the filter element is less than the force required to tear the cup-shaped filter element.

4. A method as claimed in claim 2, wherein the magnitude of the peak force applied to the filter element is less than 45N.

5. A method as claimed in claim 2, wherein the magnitude of the peak force applied to the filter element is less than 40N.

6. A method as claimed in claim 2, wherein the magnitude of the peak force applied to the filter element is less than 30N.

7. A method as claimed in claim 1 wherein, at the end of step b), a portion of the cup-shaped filter element is held in contact with the cup-shaped capsule body by the weld-head.

8. A method as claimed in claim 1 wherein the cup-shaped filter element is bonded to the cup-shaped capsule body such that the cup-shaped filter element is suspended within the cup-shaped capsule body, with a base of the cup-shaped filter element being out of contact with a base of the cup-shaped capsule body.

9. A method as claimed in claim 1, wherein, during step d), a portion of the cup-shaped filter element is bonded to the cup-shaped capsule body by using a heated portion of the weld-head.

10. A method as claimed in claim 9, wherein, during step d), at least a portion of the cup-shaped capsule body is softened by the heated portion of the weld-head, thereby allowing the weld-head to move further into the cup-shaped capsule body.

11. A method as claimed in claim 10, wherein during said further movement of the weld-head into the cup-shaped capsule body, further movement of the spring-loaded former into the cup-shaped capsule body is limited or avoided by allowing the spring-loaded former to move relative to the weld-head against the spring bias.

12. A method as claimed in claim 1, wherein the spring-loaded former is slidably coupled to the weld-head, with a compression spring extending between the spring-loaded former and the weld-head.

13. A method as claimed in claim 1, comprising the further step of:

e) withdrawing the combined weld-head and former from the cup-shaped capsule body.

14. A method as claimed in claim 13, wherein during step e) the spring-loaded former flexes to aid decoupling of the spring-loaded former from the cup-shaped filter element.

15. A method of making a beverage capsule, comprising the steps of:

i) filling a portion of one or more beverage ingredients into a cup-shaped capsule body having a filter element bonded thereto by the method of claim 1; and ii) closing and sealing the cup-shaped capsule body using a lid.

16. A method as claimed in claim 1, wherein step d) includes using the weld-head to bond the cup-shaped filter element to the interior of the cup-shaped capsule body.

17. A method as claimed in claim 1, wherein the side wall of the forming body has a generally frusto-conical shape.

18. A method as claimed in claim 1, wherein a compression spring extends between the spring-loaded former and the weld-head, and wherein the compression spring is arranged within the cup-shaped forming body.

19. A combined weld-head and former for use in assembling a beverage capsule, comprising a weld-head and a former, wherein the former is spring-loaded;

wherein the spring-loaded former comprises a cup-shaped forming body, wherein a cup-shaped portion of the forming body is wholly formed from a flexible material, and wherein the forming body comprises a base and upwardly extending side wall.

20. A combined weld-head and former as claimed in claim 19, wherein the spring-loaded former is slidably coupled to the weld-head, with a spring extending between the spring-loaded former and the weld-head.

21. Use of a combined weld-head and former as claimed in claim 19 to assemble a filter element with a cup-shaped capsule body.

22. A combined weld-head and former as claimed in claim 19, wherein the side wall of the forming body has a generally frusto-conical shape.

23. A combined weld-head and former as claimed in claim 19, wherein a compression spring extends between the spring-loaded former and the weld-head, and wherein the compression spring is arranged within the cup-shaped forming body.

* * * * *